US011541967B2

(12) United States Patent
McClellan et al.

(10) Patent No.: US 11,541,967 B2
(45) Date of Patent: Jan. 3, 2023

(54) MARITIME AUTOMATED ALIGNMENT AND CONNECTION SYSTEM

(71) Applicant: Huntington Ingalls Industries, Inc., Newport News, VA (US)

(72) Inventors: Ronald A. McClellan, Ocean Springs, MS (US); Conlan Hsu, Mobile, AL (US); Ross Buck, Mobile, AL (US)

(73) Assignee: HUNTINGTON INGALLS INDUSTRIES, INC., Newport News, VA (US)

( * ) Notice: Subject to any disclaimer, the term of this patent is extended or adjusted under 35 U.S.C. 154(b) by 141 days.

(21) Appl. No.: 17/175,383

(22) Filed: Feb. 12, 2021

(65) Prior Publication Data

US 2021/0284289 A1 Sep. 16, 2021

Related U.S. Application Data

(60) Provisional application No. 62/989,424, filed on Mar. 13, 2020.

(51) Int. Cl.
*B63B 23/18* (2006.01)
*B63B 23/60* (2006.01)

(52) U.S. Cl.
CPC ..... *B63B 23/18* (2013.01); *B63B 23/60* (2013.01)

(58) Field of Classification Search
CPC ..... B63B 23/00; B63B 23/18; B63B 23/30; B63B 23/60; B63B 23/70; B63B 21/08; B63B 2021/003
USPC ..... 114/365, 374, 375
See application file for complete search history.

(56) References Cited

U.S. PATENT DOCUMENTS 7,350,475 B2 * 4/2008 Borgwarth ..... B63B 35/40 114/260
8,578,872 B1 * 11/2013 Spellacy ..... B63B 27/36 114/259
10,315,738 B2 * 6/2019 Imel ..... B63C 1/02

* cited by examiner

*Primary Examiner* — Daniel V Venne
(74) *Attorney, Agent, or Firm* — Shook, Hardy and Bacon L.L.P.

(57) ABSTRACT

A maritime alignment and connection system allows a boat to be recovered and docked while a host vessel is underway. Components form a cradle to guide and slow an approaching boat into a desirable orientation such that the boat will be held in place in the cradle. Once captured, the boat can be locked in position to prevent it from inadvertently slipping its berth.

20 Claims, 12 Drawing Sheets

MARITIME AUTOMATED ALIGNMENT AND CONNECTION SYSTEM

CROSS-REFERENCE TO RELATED APPLICATIONS

This patent application claims the benefit of U.S. provisional application No. 62/989,424, filed on Mar. 13, 2020, the contents of which are incorporated in their entirety herein.

BACKGROUND OF THE INVENTION

The current state of the art for recovering, refueling, or replenishing small boats and unmanned surface vessels (USVs) by a host vessel requires skilled deckhands or sea-sensitive systems. For example, some unmanned solutions, such as a towed refueling drogue, permit a boat or USV to be refueled without being recovered but are not capable of operating in operationally-realistic sea states, such as when the seas and swells exceed certain maximum thresholds (e.g., they may be operationally hindered above sea state zero and operationally ineffective above sea state one). Conventionally, boats are recovered by a host ship prior to personnel transfers, refueling operations, and the like so as to minimize dangerous time when a small boat is moving freely alongside a larger ship. For example, a boat may be hoisted from the water and placed "at the hip" of a host ship, in a partially recovered position that saves time by placing the small boat at the host ship's gunnel instead of hoisting it all the way to the boat cradle. Regardless of whether a host ship uses a crane, davit, hoist, or stern ramp to recover a small boat, recovering a small boat requires a skilled coxswain and skilled deckhands, working in concert, in order to properly position the small boat with respect to the recovery equipment. For example, a typical small boat recovery may involve a coxswain carefully positioning the small boat alongside and a crewmember catching a block and tackle and fastening the boat to tackle so it may be hoisted. Every small boat recovery is a potentially dangerous evolution, risking damage to the boat, the host ship, or boat crew (e.g., due to collision or a crew member being struck by a recovery component like a boat davit or block and tackle).

Unlike larger surface assets, smaller boats, including USVs generally must be recovered prior to refueling or resupplying; that is, the current state of the art does not provide operationally tolerant solutions for efficiently replenishing or refueling without recovering the boat and bringing it at least partially aboard the host ship. Systems configured primarily for the underway refueling of a small boat or USV or for transferring information stored locally on the USV to the host ship utilize various sea-state-sensitive devices, such as drogues. Because of the relative motion between the host ship, drogue, and USV, it takes very little seas or swells to make a connection between the host ship and the USV difficult or impossible.

SUMMARY

A high-level overview of various aspects of embodiments of the invention is provided here to provide an overview of the disclosure and to introduce a selection of concepts that are further described below in the detailed description section. This summary is not intended to identify key features or essential features of the claimed subject matter, nor is it intended to be used as an aid in isolation to determine the scope of the claimed subject matter.

In its broadest sense, the invention includes the use of a boat recovery system comprising various components that align a boat and connect it to a host ship such that it may be used in operationally-relevant sea states. More specifically, the alignment and connection system comprises one or more alignment and connection components, such as an alignment ramp, alignment arms, a roll plate, a hard capture port, and one or more standoff arms, any one or more of which work cooperatively to guide a small boat into a docked configuration, slow the forward momentum of the boat's approach, create a lockable connection between the boat and host ship, and allow the docked small boat and other system components to move with the sea. The alignment and connection system may be coupled to or integrated into a host ship using various ways, including through the use of a stern ramp, integration into a well deck, a boom arm, pontoon, or a tracked system, for example. Once recovered and in the locked position, the small boat may be refueled, maintained, or replenished; service transfers may be made (e.g., data or fuel transfers); or personnel/material transfers may occur. Because skilled boat operators or deckhands are not necessary to at least partially bring the small boat aboard the host ship and because the system is not compromised by sea states above sea state zero, boat recovery operations are faster, safer, and more permissive in operationally-realistic sea conditions.

BRIEF DESCRIPTION OF THE SEVERAL VIEWS OF THE DRAWINGS

Illustrative embodiments of the present invention are described in detail below with reference to the included drawing figures, wherein.

DETAILED DESCRIPTION

Figure 1:
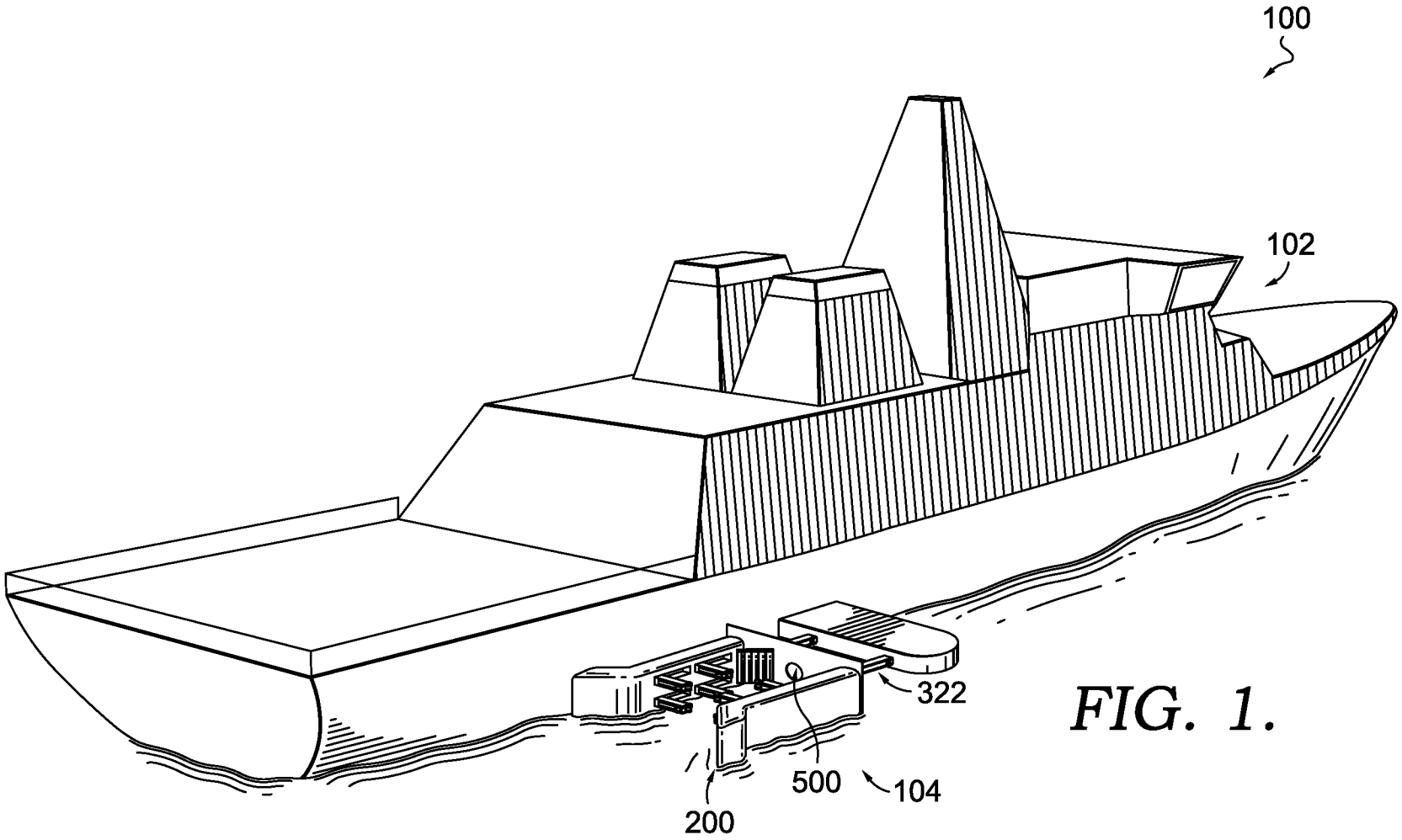
FIG. 1 illustrates an exemplary alignment and connection system coupled to a host ship, implemented in accordance with an embodiment of the present invention.

Embodiments of the present invention relate generally to an alignment and connection system for receiving and coupling a small boat (e.g., a USV) to a host ship. Accordingly, the present invention implements a cradle, coupled to a host ship via one or more standoff arms and a deployment system (e.g., one or more boom arms, pontoon, deployable module). Cradle components, which, in various embodiments, may comprise one or more of an alignment ramp, alignment arms, and bumpers, guide the boat into proper alignment and slow or arrest the forward momentum of the boat to avoid damaging the alignment and connection system. The cradle may be coupled to the alignment arms via a roll plate, which allows the cradle to rotate with the motion of the sea and houses the hard capture port and locking mechanism. The standoff arms couple the roll plate to the host ship, optionally via one or more boom arms, wherein each of the standoff arms comprise one or more joints that permit the cradle to move vertically with the sea. Many nautical terms are used throughout this disclosure and should be understood to be used in their conventional, nautical sense; for example, the term "centerline" refers to an imaginary fore and aft line that runs through the center of a ship, boat, or component, wherein "inboard" is a relative term meaning closer to the centerline and "outboard" meaning further from the centerline.

In a first aspect, an alignment and connection system is provided that includes a plurality of cradle arms, a plurality of alignment arms, an alignment ramp, a roll plate, and a hard capture port. Each cradle arm of the plurality of cradle arms is coupled to the aft surface of the roll plate. The cradle arms are each configured to include a pocket that is configured to receive at least one alignment arm and at least one articulating component configured to extend the one or more alignment arms angularly outward from an inner-facing surface of each cradle arm. Each alignment arm of the plurality of alignment arms is coupled to a cradle arm of the plurality of cradle arms at a first end of each alignment arm and comprises at least one roller coupled to a second end of the alignment arm, where the second end opposite the first end.

In another aspect, a system for capturing and docking a boat is provided that includes a plurality of cradle arms. Each of the plurality of cradle arms is coupled to an aft surface of a roll plate and comprises at least one pocket configured to receive one or more alignment arms. Each of the plurality of cradle arms includes at least one articulating component configured to extend the one or more alignment arms angularly outward from an inner-facing surface of each cradle arm and is configured to releasably hold a docked boat in a predetermined position. Each of the cradle arms also includes a plurality of alignment arms, each alignment arm of the plurality of alignment arms coupled to a cradle arm of the plurality of cradle arms at a first end of each alignment arm. The plurality of alignment arms include at least one roller coupled to a second end of the alignment arm, the second end opposite the first end. The system further includes an alignment ramp coupled to the roll plate, wherein the alignment ramp extends aft at a downward angle from the roll plate.

In yet another aspect, a shipborne recovery system is provided that includes an alignment and connection system and a host ship. The alignment and connection system includes a plurality of cradle arms. Each of the plurality of cradle arms is coupled to an aft surface of a roll plate. The alignment and connection system also includes an alignment ramp coupled to the roll plate that extends aft at a downward angle from the roll plate. The roll plate features a hard capture port, having an aperture centered on the roll plate between each of the plurality of cradle arms and one or more retention components coupled to a forward surface of the roll plate at the aperture.

In FIG. 1, an illustration of an exemplary automated alignment and connection system (AACS) used to recover and capture a boat is shown coupled to a host ship. A shipborne recovery system 100 comprises at least a host ship 102 and the AACS 104. The host ship 102 may take any desirable form, such as a surface combatant (e.g., destroyer, frigate), amphibious warfare ship, aircraft carrier, law enforcement vessel (e.g., United States Coast Guard (USCG) cutter), or any other type or class of vessel in which it may be desirable to recover a small boat. Though the AACS 104 is depicted in FIG. 1 on the starboard side of the host ship 102, it is understood that the AACS 104 may be located on the port side of the host ship 102, or incorporated into the stern of the host ship 102 (e.g., stern gate on an amphibious assault ship or stern ramp on a USCG cutter), as will be discussed in greater detail, for example, with respect to FIGS. 6A-8B. As will be discussed in greater detail, the AACS 104 may be generally said to comprise a cradle 200, at least one standoff arm 322, and a hard capture port 500. Working cooperatively, the components of the AACS 104 guide a boat as it enters the cradle 200 and approaches the hard capture port 500. Components of the cradle 200 align the boat such that it may be captured in the proper configuration and slow the boat until it comes to rest in the captured position.

Figure 2A:
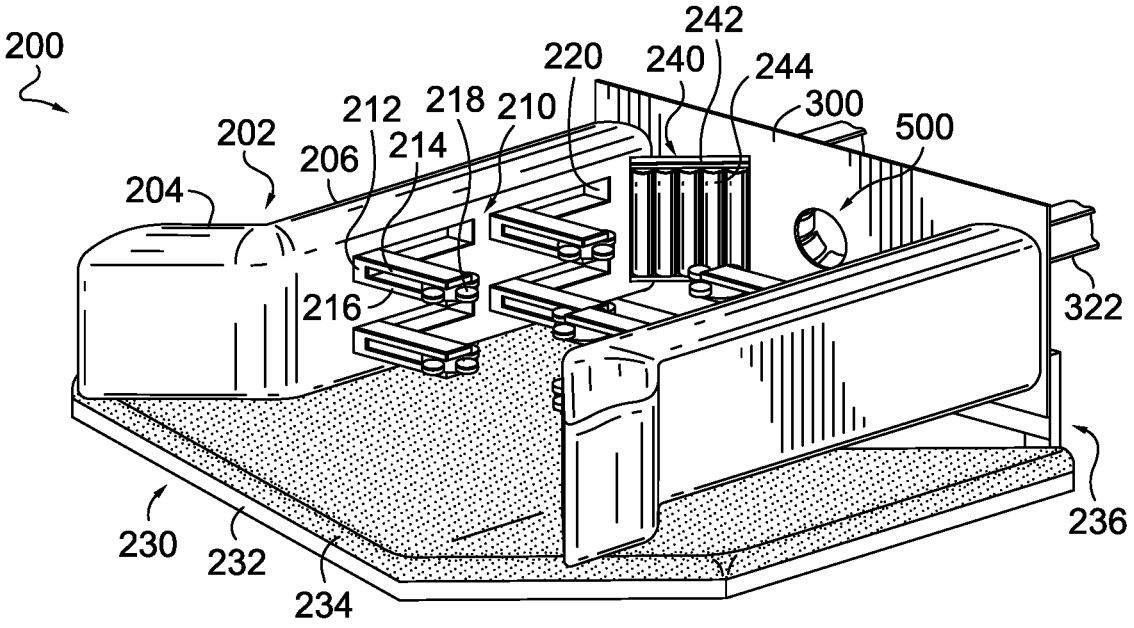
FIGS. 2A-2B illustrate exemplary cradle components of the alignment and connection system of FIG. 1, implemented in accordance with an embodiment of the present invention.
Figure 2B:
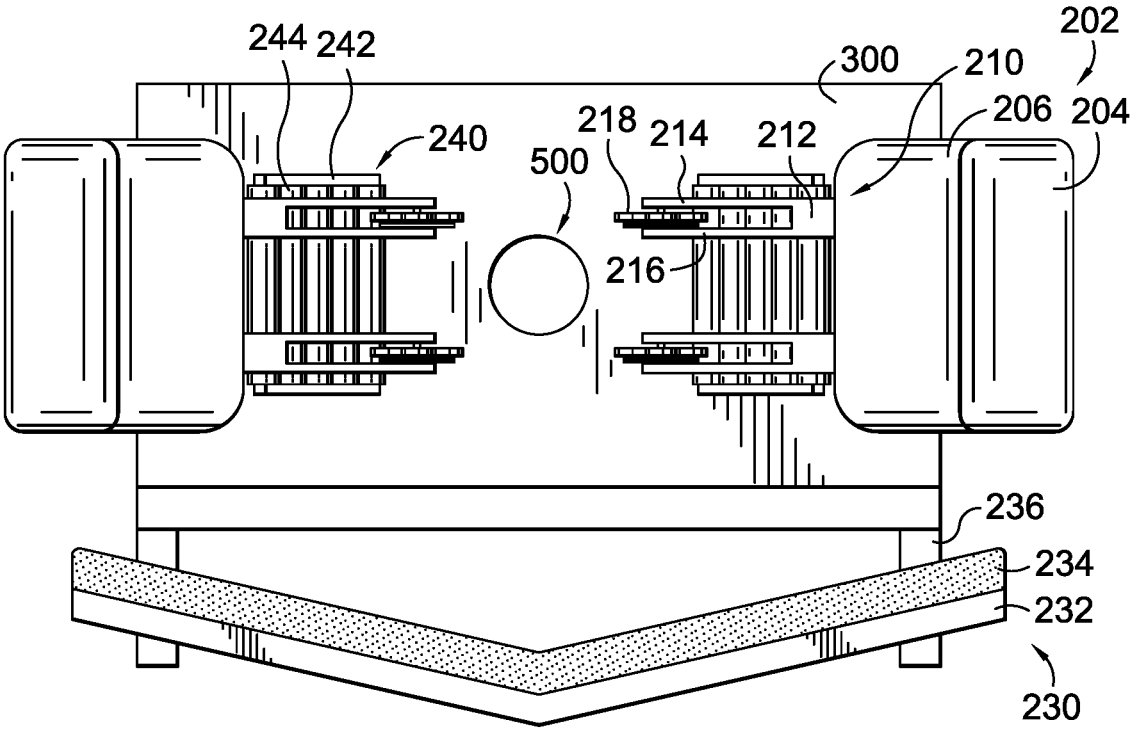

Turning to FIGS. 2A and 2B, exemplary cradle components of the AACS are illustrated. The cradle 200 may comprise one or more subsystems that work cooperatively to align, slow, and capture a boat during its recovery. Embodiments of the cradle 200 may comprise one or more cradle arms 202, an alignment ramp 230, one or more alignment arms 212, bow bumpers 240, a roll plate 300, and a hard capture port 500.

In embodiments, the cradle 200 may comprise one or more cradle arms 202. Though shown as having two distinct cradle arms 202 in FIGS. 2A and 2B, it is conceived that the cradle arms 202 could take the form of a single unitary cradle arm; or each of the discrete cradle arms 202 shown in FIGS. 2A and 2B could be further divided into a plurality of cradle arms. For example, one side (e.g., the port side or starboard side) of the cradle arms 202 may take the form of a plurality of substantially vertically-stacked members, wherein each member may comprise one or more alignment arms 212. In such aspects, the substantially parallel members may be vertically aligned, wherein a generally constant distance separates the members of a first (e.g., port) side and a second (e.g., starboard) side. In another aspect, the substantially parallel members may be horizontally offset such that they are not vertically aligned, wherein a lower cradle arm member on each of the first and second side have less space there between than an upper cradle arm member on each of the first and the second side. Aspects having divided cradle arm members may reduce the amount of material needed to make the cradle 200 and may be configured to more effectively recover boats having a particular hull contour.

Generally, the cradle arms 202 may be said to comprise a first portion 206 and a second portion 204. The first portion 206 of the cradle arms 202 is coupled to, or may be unitary with, the roll plate 300, which generally defines the forward portion of the cradle 200. The first portion 206 of the cradle arms 202 extends away from the roll plate 300 in a particular direction (e.g., aft, as illustrated), and may be coupled to a discrete second portion 204 or shaped to become a distinct second portion 204. In aspects, the second portion 204 of the cradle arms 202 flares outboard of the centerline of the cradle 200 so as to increase the initial target size for the boat on its approach to the cradle 200 and to guide it into the narrower portion of the cradle 200, the sides of which are generally defined by the first portion 206 of the cradle arms 202. In other aspects, the second portion 204 may not be flared outboard of the centerline of the cradle 200, but may be tapered or constructed of a shock-absorbent material in order to deflect or absorb any initial contact between the bow of the boat and the cradle 200 as the boat enters the cradle 200. Each of the first portion 206 and the second portion 204 may be constructed of a structural material (e.g., solid steel), a shock-absorbing material (e.g., rubber), or a material having buoyant properties (e.g., a rubber bladder creating positive buoyancy for the cradle 200 or a metal pontoon creating neutral buoyancy for the cradle 200).

In embodiments, the cradle 200 may comprise a plurality of alignment arms 212. The alignment arms 212 and associated components generally operate to provide resistive force against a boat as it is entering the cradle 200 and proceeding forward towards the roll plate 300, serving to align and center the boat in the cradle 200 and guide a docking component coupled to the boat into the hard capture port 500. The cradle 200 may comprise a plurality of alignment arms 212 on each inboard facing surface of both port and starboard cradle arms 202 at a plurality of vertical and horizontal positions, and may be aligned or offset in respective vertical or horizontal planes. As illustrated in FIG. 2A, each of the port side cradle arm 202 and the starboard side cradle arm 202 may comprise a forward superior alignment arm, a forward inferior alignment arm, an aft superior alignment arm, and an aft inferior alignment arm, wherein the superior alignment arms are horizontally aligned, the inferior alignment arms are horizontally aligned, the forward alignment arms are vertically aligned, and the aft alignment arms are vertically aligned. All of the plurality of alignment arms 212 may be above the waterline of the cradle 200 or a portion of the plurality of alignment arms 212 may be below the waterline (e.g., the inferior alignment arms) and the remainder of the plurality of alignment arms 212 may be at or above the waterline. The plurality of alignment arms in various vertical positions accommodates boats of varying hull flares to be recovered and the plurality of alignment arms in various horizontal positions accommodates boats of varying bow and beam configurations.

The alignment arms 212 are coupled to the cradle arm 202 at a first end and comprise one or more rollers 218 at or proximate to a second end, the second end opposite the first end. The roller 218 may be integrated into the second end of the alignment arm 212 or may be coupled to the alignment arm 212 at or near the second end. In some aspects, each alignment arm 212 may comprise a plurality of rollers, or a single central roller with a plurality of rollers protruding therefrom (e.g., having a profile of a clover leaf). In one embodiment, the alignment arm 212 may divide into a first member 214 and a second member 216 as it extends inboard the cradle 200 from the first end of the alignment arm 212. In aspects that divide into a first member 214 and a second member 216, the roller 218 may be coupled to one or both of the first member 214 and the second member 216, or the roller 218 may be disposed in a space between the first and second member (as illustrated). The length of alignment arm 212 may vary based on operational requirements and may be hinged or otherwise rotatably or detachably connected at the first end of the alignment arm 212 to the cradle arms 202 generally, the first portion 206 of the cradle arms 202, or in a pocket 220 comprising a cavity on the inboard facing surface of the cradle arms 202. The cradle arms 202, or another portion of the AACS 104, such as the roll plate 300, may comprise one or more of a service transfer port (e.g.,) and a refueling probe (e.g., a drogue, nozzle, wand, or arm configured to physically connect to and refuel the boat 400 when captured or docked). The service transfer port may be configured to facilitate any desirable transfer between the ship 102 and the boat 400; for example, the service transfer port may comprise a data transfer port for transmitting and/or receiving information (e.g., a wireless networking interface or a probe for establishing a physical data connection with the boat 400 while the boat is in the capture or docked position), a fuel transfer port configured to onload or offload fuel, a sewage transfer port, air transfer port, ballistic transfer port (e.g., for onloading or offloading arms or ammunition) and the like.

Each cradle arm 202 may comprise a at least one pocket 220 disposed on the inboard facing surface of the cradle arm 202 configured to receive and stow one or more alignment arms 212 when not articulated and at least one alignment arm articulating component (e.g., a spring, piston, hydraulic actuator). The alignment arm articulating component is configured to extend the one or more alignment arms 212 angularly outward from the inboard facing surface of the cradle arm 202 and configured to resist or prevent the alignment arms 212 from being returned into the pocket 220. The alignment arm articulating component may be static (e.g., a spring), wherein it is configured to articulate the alignment arm 212 to a particular angle (e.g., not to exceed 90 degrees angularly extended from the inner surface of the cradle arm 202). The alignment arm articulating component may be dynamic or controllable, wherein the alignment arm articulating component can be operated to controllably articulate the alignment arm 212 to a desired angle (e.g., to apply more force to keep the boat in the captured position) or to retract the alignment arm 212 (e.g., in anticipation of launching the boat).

In some embodiments, the alignment arms 212 may resist but not prevent aft-movement of the boat once it is has been captured in the cradle (i.e., fully recovered). Such embodiments may be particularly desirable when the cradle 200 comprises a hard capture port 500 and locking mechanism that holds a captured boat in position without the need of any other subcomponent of the cradle 200. Accordingly, the alignment arms 212 may be configured to extend less than 90 degrees from their stowed position in the alignment arm pocket 220 or the rollers 218 may be allowed to freely rotate in both directions in order to avoid preventing the boat from moving aft out of the cradle 200 when the boat is launched but serve to guide the boat or provide standoff from the cradle arms 202 as the boat launches.

In some embodiments, such as those that do not utilize a locking mechanism at the hard capture port 500, it may be desirable to use the alignment arms 212 to selectively prevent the captured boat from moving aft out of the cradle. In such embodiments, the alignment arms 212 may, instead of being a static length, be extendable in order to provide constant inward force against a captured boat. Further, the rollers 218 may be selectively locked to prevent any rotation or ratcheted in order to prevent rotation that would allow for aftward movement (i.e., the rollers 218 only allow a boat to move forward in the cradle 200, or may take the form of a bumper or fender and may not have any rotational properties. In embodiments, the alignment arms 212 may be articulated to a desirable angle by the alignment arm articulating component in order to establish or maintain forward and inboard force against the captured boat. When the boat is to be launched, the alignment arm articulating component may retract the alignment arms 212 towards or in to the pocket 220, the rollers 218 may be unlocked, or the alignment arms 212, if extendable, may be at least partially retracted, or a combination thereof and, in some aspects, may guide the release of the boat from the cradle 200. In other embodiments, the hull contours of the captured boat may comprise specific notches or indentations or other innate external artifacts that align with the capture mechanisms such that the capture mechanisms naturally or actively hold the boat in place once it has advanced to a specific forward distance within the cradle relative to the roll plate 300.

In embodiments, the cradle 200 may comprise an alignment ramp 230. The alignment ramp 230 is generally configured to provide a base or platform to support the hull of the recovered boat and align the boat as it proceeds forward to its capture configuration. The alignment ramp 230 may be coupled directly to the roll plate 300 or, as shown in FIGS. 2A and 2B, the alignment ramp 230 may be coupled to the roll plate 300 via one or more ramp brackets 236. The alignment ramp may be said to comprise a first angular portion and a second angular portion that meet to form a cradle hull. In the embodiment shown in FIGS. 2A and 2B, the angular portions are linear and meet to form a V-shaped hull or keel; in other embodiments, the angular portions may be curved to form a U-shaped hull or keel or may be formed in any other configuration that is appropriate for the type(s) of boats that will be recovered in the cradle 200.

The alignment ramp 230 may be formed of a multi-layer material, such as a first layer 232 and a second layer 234, or may be a single material. In multi-layer embodiments, the first layer 232 may be formed of a structural material (e.g., steel) that provides rigidity and support for the boat and for the second layer 234 of the alignment ramp 230. The second layer 234 may be formed of a corrosion-resistant material (e.g., polymers, plastics, etc.) with a coefficient of friction that may work cooperatively with other components of the cradle 200 to slow the forward momentum of the boat as it is being recovered and avoid damaging the keel or hull of the boat (e.g., Jet-Dock tiles). In some aspects, the materials used to construct the alignment ramp 230 or one or more layers thereof may have floating properties.

In order to further provide alignment and momentum-slowing benefits, the alignment ramp may be sloped or angled, such that it forms a type of incline plane as it extends forward towards the roll plate 300. In one aspect, the slope or angle of the alignment ramp 230 may be such that the aft end of the alignment ramp is fully immersed below the surface of the water and the forward end is only partially immersed or not immersed in water when the cradle 200 is deployed for boat recovery.

In embodiments, the cradle may comprise one or more bow bumpers 240. The bow bumper 240 serves to slow or arrest forward motion of the boat when it has reached the capture position in the cradle 200. Though shown as coupled to the roll plate 300, the bow bumper 240 may be coupled to one or more of the roll plate 300 and the cradle arm 202. The bow bumper 240 may comprise a plate 242 and one or more bumpers (i.e., fenders) 244 coupled to the plate 242, wherein the one or more bumpers 244 are constructed of a material that is shock absorbing and unlikely to damage the hull of the boat during recovery (e.g., rubber, polymer, plastic, foam, and the like). Though depicted as proximate to the cradle arms 202, the bow bumper 240 may be proximate to, adjacent, or may envelop the hard capture port 500. For example, the bow bumper 240 may be circular with a cutout (e.g., like a donut) that may surround or envelop the hard capture port 500 in order to protect the cradle 200 from boats having a narrower bow or to specifically protect the hard capture port 500 and the locking mechanism on the opposite face of the roll plate 300.

Figure 3:
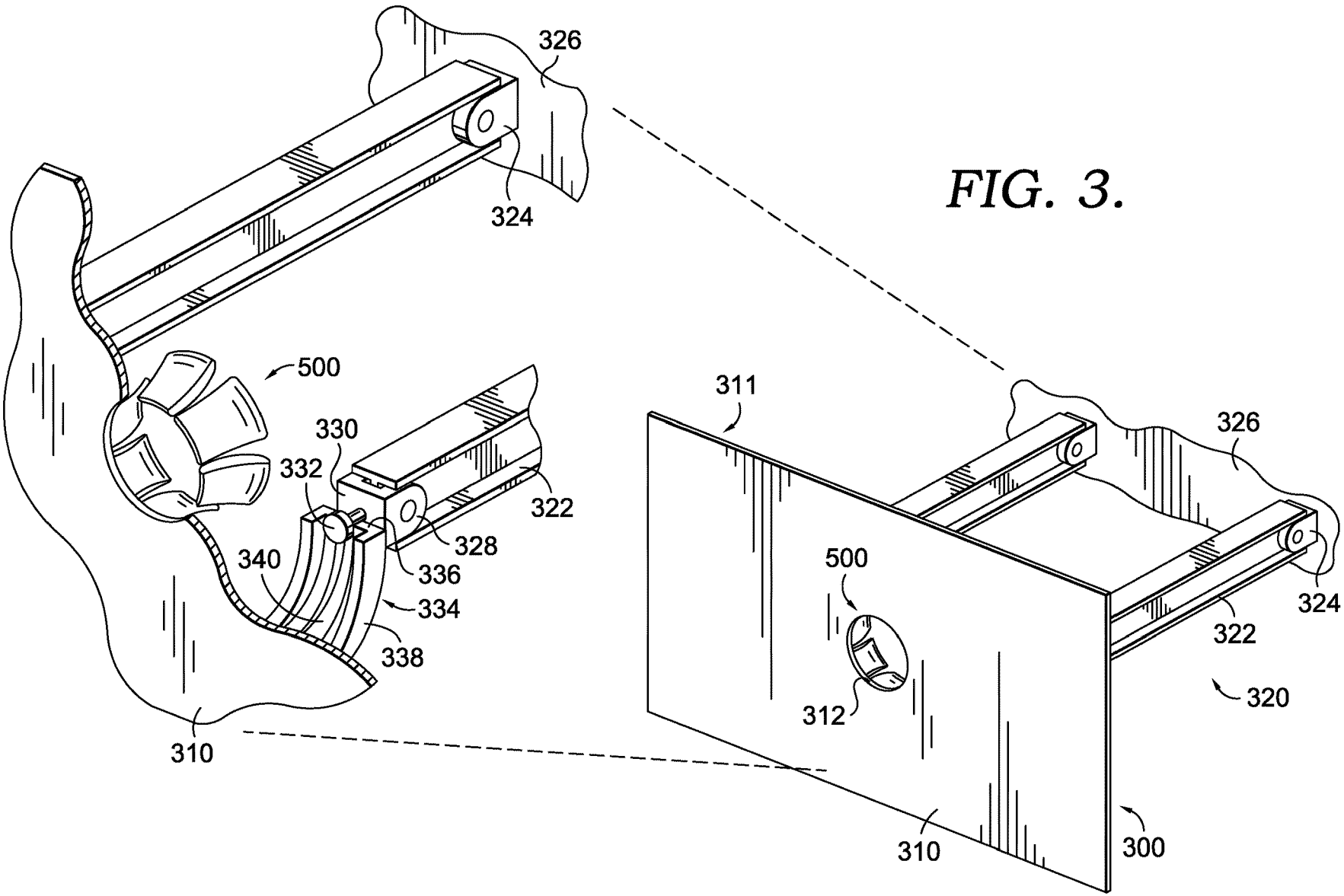
FIG. 3 is an exemplary roll plate, hard capture port, and standoff arms of the alignment and connection system of FIG. 1, implemented in accordance with an embodiment of the present invention.

Turning now to FIG. 3, an exemplary roll plate 300, hard capture port 500, and standoff arms 322 of the alignment and connection system of FIGS. 1-2B are shown, in accordance with one or more embodiments of the present invention. In embodiments, the roll plate 300 is generally configured to allow the cradle 200 of FIGS. 1-2B to rotate about a roll axis. By permitting the cradle to roll, the AACS places the cradle in a similar orientation of the boat, vis-à-vis the water's surface. In embodiments the roll plate 300 may comprise an aft facing surface 310 and a forward facing surface 311 opposite the aft facing surface 310. The roll plate 300 may feature an aperture 312 that extends from the aft facing surface 310 to the forward facing surface 311. The aperture 312 may be configured to receive a bow connecting device from the boat and define the opening to the hard capture port 500.

A roll bracket 334 coupled to the forward facing surface 311 of the roll plate 300 permits the cradle 200 of FIGS. 1-2B to roll independently. The roll bracket 334 may comprise a first portion 338 that extends perpendicularly outward from the forward facing surface 311 of the roll plate 300 and a second portion 336 coupled to the first portion 338 and substantially parallel to the roll plate 300. The first portion 338 and second portion 336 of the roll bracket 334 define a slot or track 340 that allows the roll bracket 334 to rotate about a fixed pin 332, wherein the pin 332 is coupled to a surface 330 of an aft pivot joint 328 rotatably coupled to a standoff arm 322. The standoff arm 322 may be constructed of any suitable material (e.g., steel I-beam) that can securely retain the cradle to the shipborne deployment component 326 and withstand the forces of the sea and boats as they are recovered in the cradle 200. Opposite the aft pivot joint 328, the standoff arm may be rotatably coupled to shipborne deployment component 326 via a forward pivot joint 324. In combination, the aft pivot joint 328 and the forward pivot joint 324 allow the cradle 200 to remain in a substantially constant horizontal orientation, moving with the seas or swells, which allows the cradle 200 to mimic the orientation of an approaching or captured boat.

Figure 4:
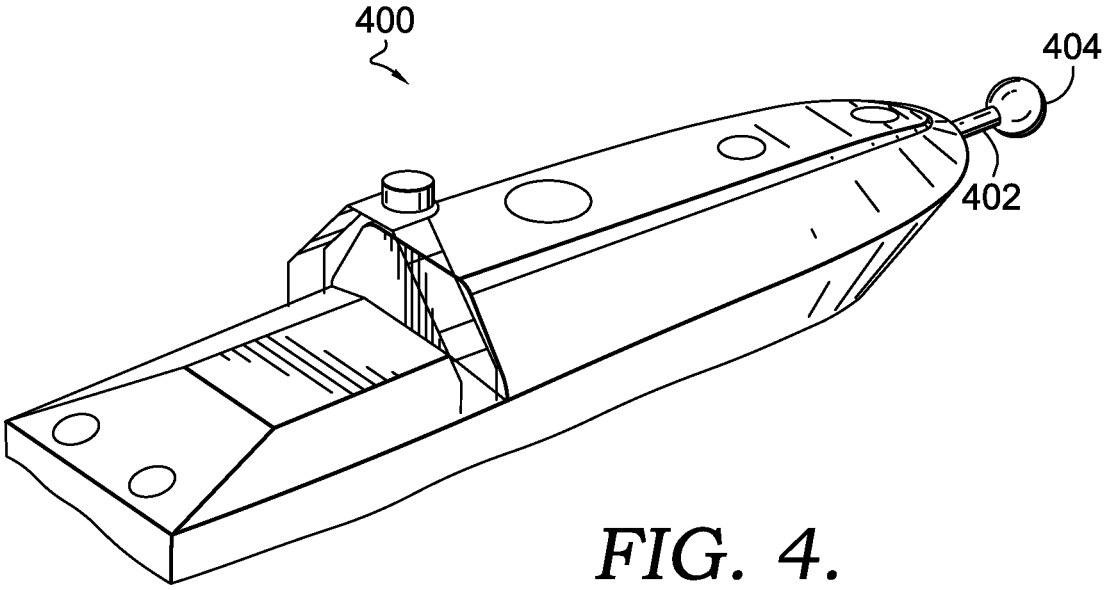
FIG. 4 is an exemplary USV, suitable for use with embodiments of the present invention.

Turning to FIG. 4, an exemplary boat 400 is shown that is suitable for use with embodiments of the present invention. The boat 400 may take any form, such as a rigid hull inflatable (RHIB), steel hull, or zodiac-style and may be manned or an unmanned surface vehicle (USV). The boat 400 may comprise a bow connecting device coupled to its bow, for example on the boat 400's centerline, at what would traditionally be referred to as the apex of the boat 400's prow. In one embodiment, the bow connecting device comprises a stem 402 and a connecting ball 404, wherein the connecting ball 404 is configured to be received by and extend through the aperture 312 of FIG. 3 and into the hard capture port 500 of FIGS. 1-3 and the stem 402 is configured to appropriately offset the connecting ball 404 from the boat 400 such that the bow of the boat 400 is aft of and adjacent to the roll plate 300 of FIGS. 2A-3 while the connecting ball 404 is mated with the hard capture port 500.

Figure 5A:
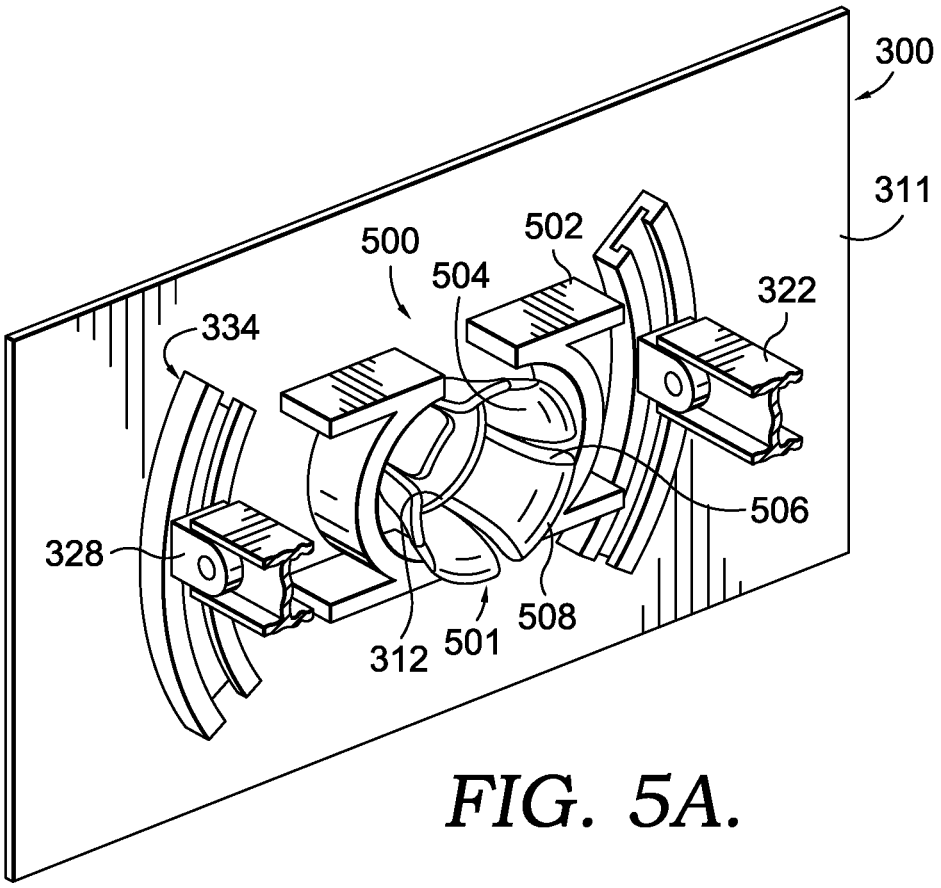
FIGS. 5A-5E are exemplary hard capture ports, implemented in accordance with an embodiment of the present invention.

FIGS. 5A-5E illustrate various embodiments of the hard capture port 500 that may comprise a portion of the AACS. When present, the hard capture port is generally configured to capture at least a portion of the docking device, such as the connecting ball 404 of the boat 400, shown in FIG. 4. The hard capture port 500 comprises one or more retention components 501 that are configured to receive and mate with the connecting ball 404, once the connecting ball 404 extends through the aperture 312 and into the hard capture port 500. In embodiments, the one or more retention components 501 are shaped or configured to resist the connecting ball 404 of boat 400 from moving aft once the connecting ball 404 has engaged with the one or more retention components 501. FIG. 5A depicts the hard capture port 500 in an undocked state (i.e., the boat with the connecting ball 404 is either not present or is not fully captured/docked). In an undocked state, the one or more retention components 501 are configured to allow the connecting ball to enter the hard capture port 500. For example, in one embodiment, the one or more retention components 501 may take the form of a plurality of flared springs 504 that extend forward from the forward surface 311 of the roll plate 300. The flared springs 504 may be constructed of any suitable material, such as steel, polymer, or the like, that have the ability to flex and contact the connecting ball 404. Each of the flared springs 504 may comprise a first portion 506 that is substantially tubular and tapers inward, which may correspond to the stem 402 of the bow connecting device of the boat 400. Each of the flared springs 504 may comprise a second portion 508 that flares outward from the roll axis of the cradle 200. The flared second portion 508 allows the connecting ball 404 to pass through and remains in contact with the connecting ball 404 when the boat 400 is captured in the cradle 200.

Figure 5B:
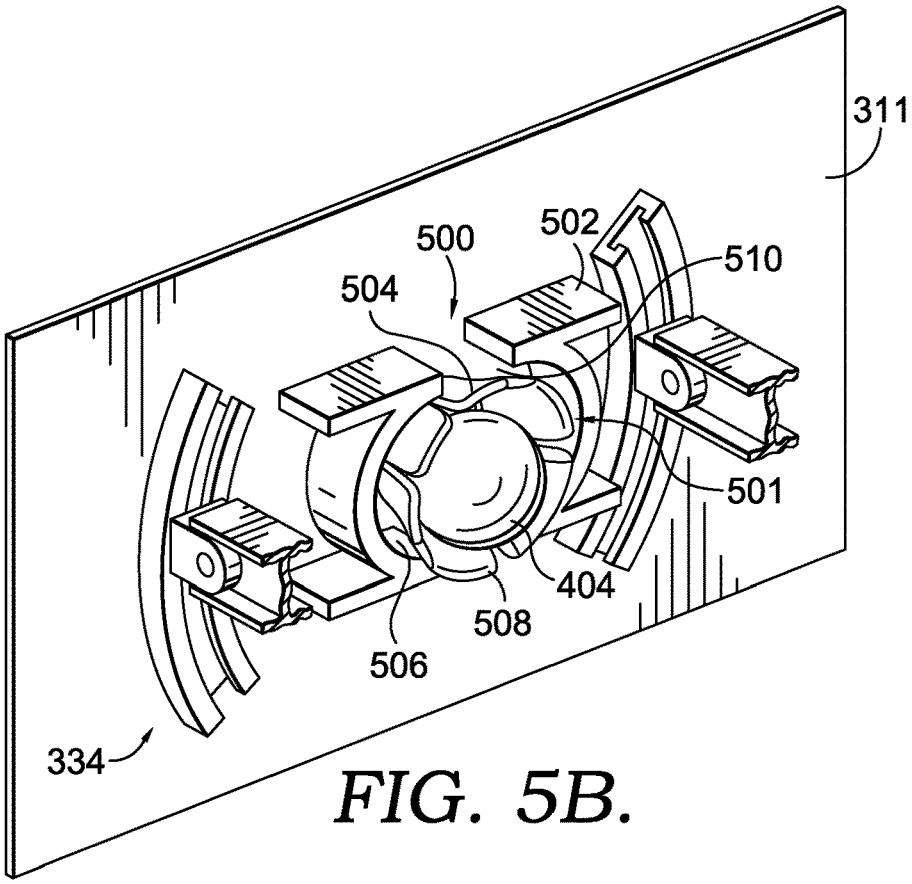

As best seen in FIG. 5B, the one or more retention components 501 are adapted to provide a resistive force to hold the connecting ball in a position forward of the roll plate 300. This position, referred to herein as the captured position, is defined by the ability of the one or more retention components 501 to resist the connecting ball 404 (and thus, the boat 400) from moving aftward and out of the cradle 200. In the captured position, if astern propulsion is utilized by the boat 400, the force will allow the connecting ball 404 to pass through the neck formed by the union of the inwardly-tapered first portion 506 and the outwardly-tapered second portion 508 of the flared springs 504, allowing the boat to launch.

Accordingly, the hard capture process may comprise the connecting ball 404 passing through the aperture 312 and into the aft portion of the hard capture port 500. As the boat 400 and the connecting ball 404 continue forward, the connecting ball 404 partially displaces or pushes apart the inwardly-tapered first portion 506 of the flared springs 504. As the forward motion of the boat 400 continues to push the connecting ball 404 forward through the first portion 506 and into the outwardly-flared second portion 508 of the flared springs 504, the flared springs 504, previously pushed away from the roll axis of the cradle 300 (i.e., a center axis of the hard capture port 500), return to their original position. The inwardly-tapered first portion 506 of the flared springs 504 applies inward pressure on the stem 402 of the bow connecting device and creates a resistive force against the connecting ball 404 that prevents the connecting ball 404 from moving aft and exiting the hard capture port 500 unless sufficient astern force is exercised. In order to launch the boat 400 from this position, the process reverses; a sufficient amount of astern force from the boat (e.g., the boat uses its drivetrain for astern propulsion) will overcome the inward force of the flared springs 504 that retained the connecting ball 404 against the second portion 508 of the flared springs 504 and push them apart sufficiently that the connecting ball 404 may pass astern through and out of the hard capture port 500.

Figure 5C:
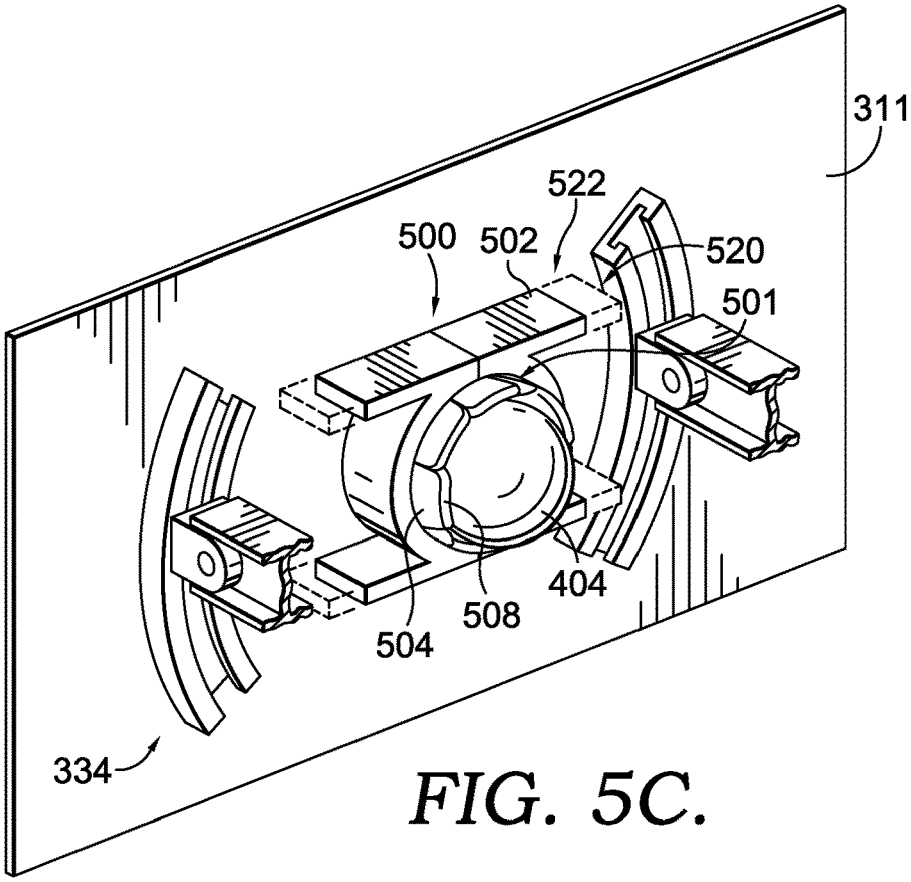

The hard capture port 500 may additionally comprise a locking mechanism 502. FIGS. 5B and 5C illustrated the locking mechanism 502 in different states. The locking mechanism 502 is operable to prevent the one or more retention components 501, such as the flared springs 504 from allowing the connecting ball 404 to pass aftward out of the hard capture port 500. In one embodiment, the locking mechanism 502 may be engaged by moving it from an unlocked position 520, seen in FIG. 5B, to a locked position 522, seen in FIG. 5C. In the locked position of the illustrated embodiment, the locking mechanism 502 prevents the flared springs 504 from flaring outward, which keeps the connecting ball 404 from passing aft through the neck formed by the first portion 506 and the second portion 508 of the flared spring 504. A locking mechanism actuator may be used to controllably engage or disengage the locking mechanism 502; for example, to engage the locking mechanism, the locking mechanism actuator (e.g., a hydraulic cylinder) may provide a unidirectional force that pushes the locking mechanism 502 inward towards the roll axis of the cradle 200, preventing the one or more retention components 501 from being sufficiently pushed apart to allow the connecting ball 404 from moving astern through the hard connection port 500. As used herein, and to differentiate it from the captured position, this configuration of components is referred to as the docked position. In the docked position, the boat 400 may not exit the cradle 200 or the AACS 104.

Figure 5D:
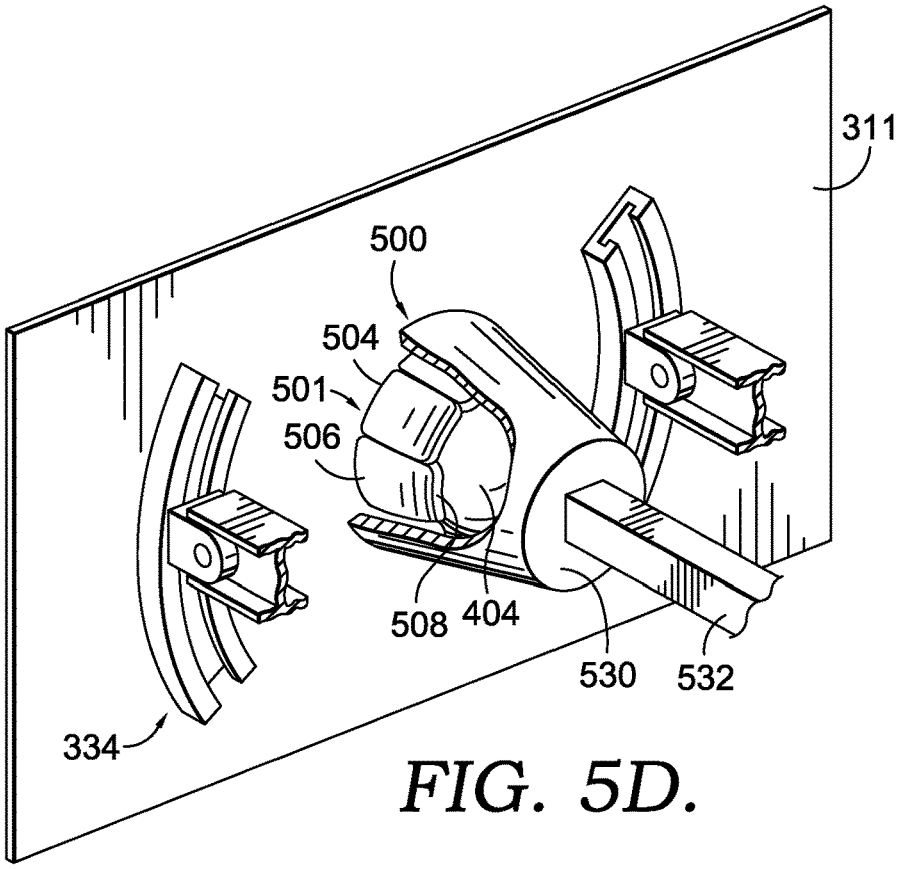

Turning now to FIG. 5D, an alternate embodiment of the locking mechanism is a conical locking mechanism 530. Like the locking mechanism 502 of FIG. 5C, the conical locking mechanism 530 prevents the flared springs 504 from flaring outward, keeping the boat 400 in the docked position. A conical locking mechanism actuator 532 may be controllably configured to position the conical locking mechanism 530 engage the conical locking mechanism by applying a unilateral astern force which causes the conical locking mechanism 530 to engage with and maintain a position that prevents the flared springs 504 from splaying. The conical locking mechanism actuator 532 may, when disengaged, move the conical locking mechanism 530 forward and off of the flared springs 504, allowing them to splay and the connecting ball 404 to pass through when sufficient astern force is realized.

Figure 5E:
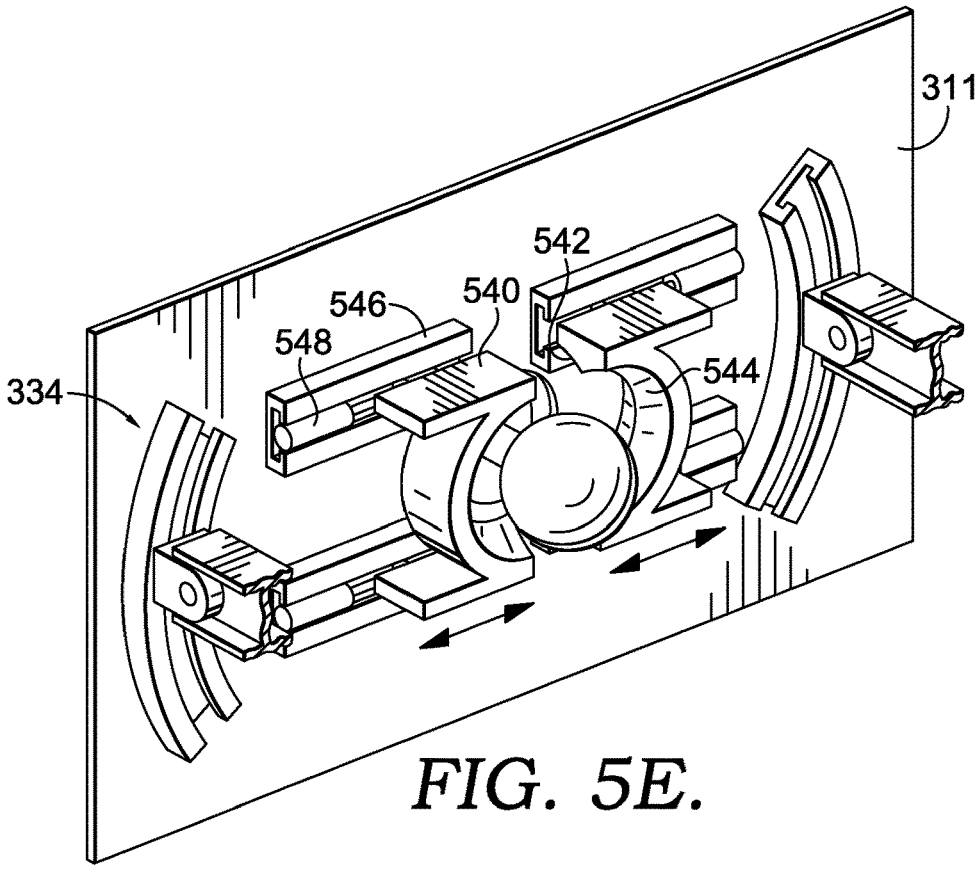

FIG. 5E illustrates an alternate locking mechanism 501. A slidable retention clip system may be said to comprise two or more retention clips 540, wherein each retention clip 540 has an aft angled face 542 and a forward angled face 544. Similar to the flared springs 504 of FIGS. 5A-5C, the retention clip 540 generally functions by allowing the connecting ball 404 of FIG. 4 to pass through and splay the retention clips 540 apart. As the connection ball 404 enters the hard connection port 500 and engages with the aft angled face 542, the connection ball 404 pushes the retention clips 540 away from the roll axis of the cradle 200, along a retention clip track 546. The retention clip system may further comprise a locking component 546. The locking component 546 may take the form of a high tension spring or hydraulic cylinder and be disposed within or proximate to the track 546. The locking component 546 may be static (e.g., a spring) and increase the inward force exerted on the retention clip 540, requiring greater force for the connection ball 404 to pass through the retention clip 540. In another embodiment, the locking component 546 may be controllable or dynamic (e.g., a hydraulic cylinder), allowing for the inward force exerted on the retention clip 540 to be increased (e.g., to place the boat 400 in the docked position) or decreased (e.g., to place the boat 400 in the capture position or to permit the boat 400 to be launched).

Figure 6A:
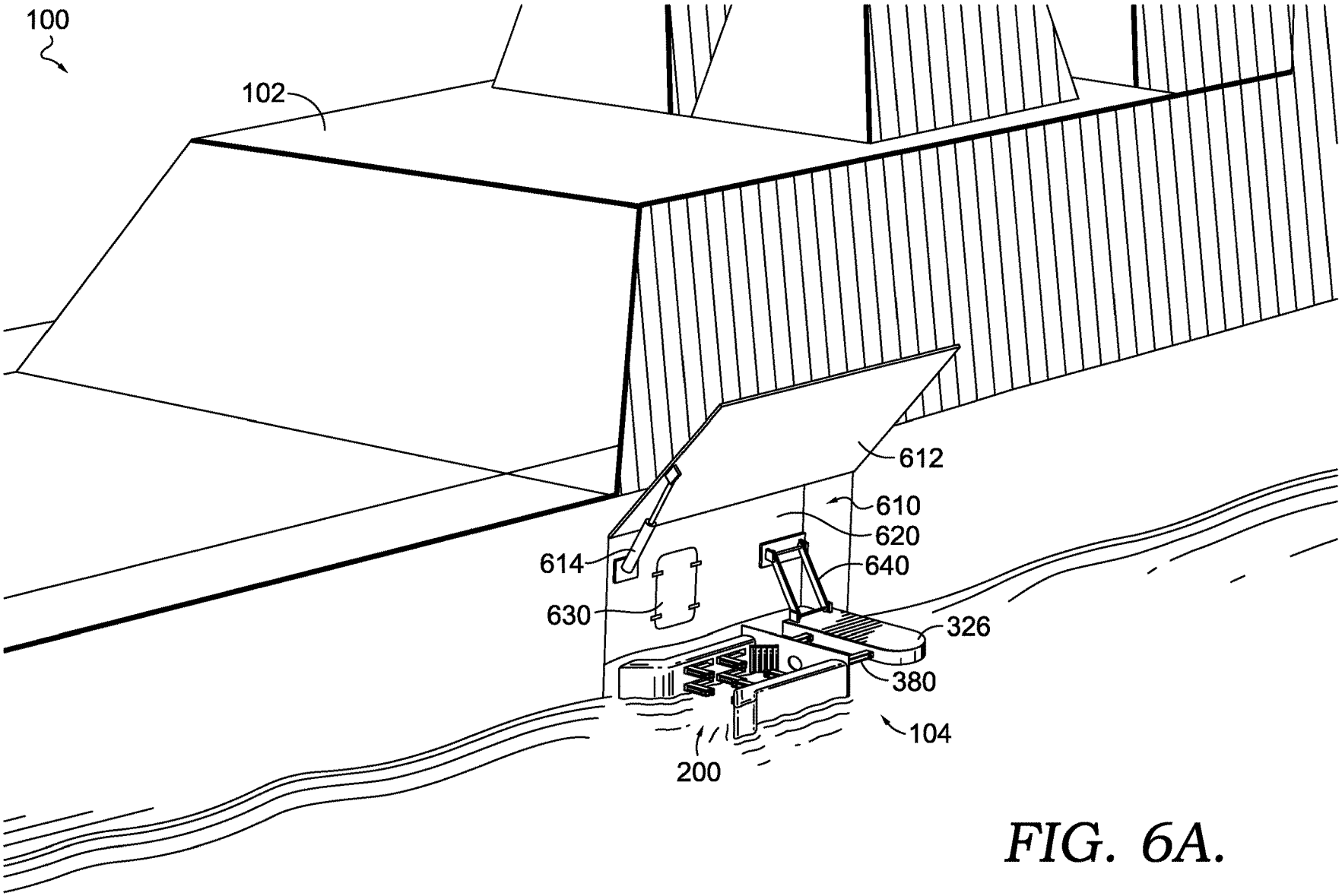
FIGS. 6A-6B illustrate exemplary configurations for stowing and deploying an alignment and connection system to the side of a host ship, implemented in accordance with embodiments of the present invention.
Figure 6B:
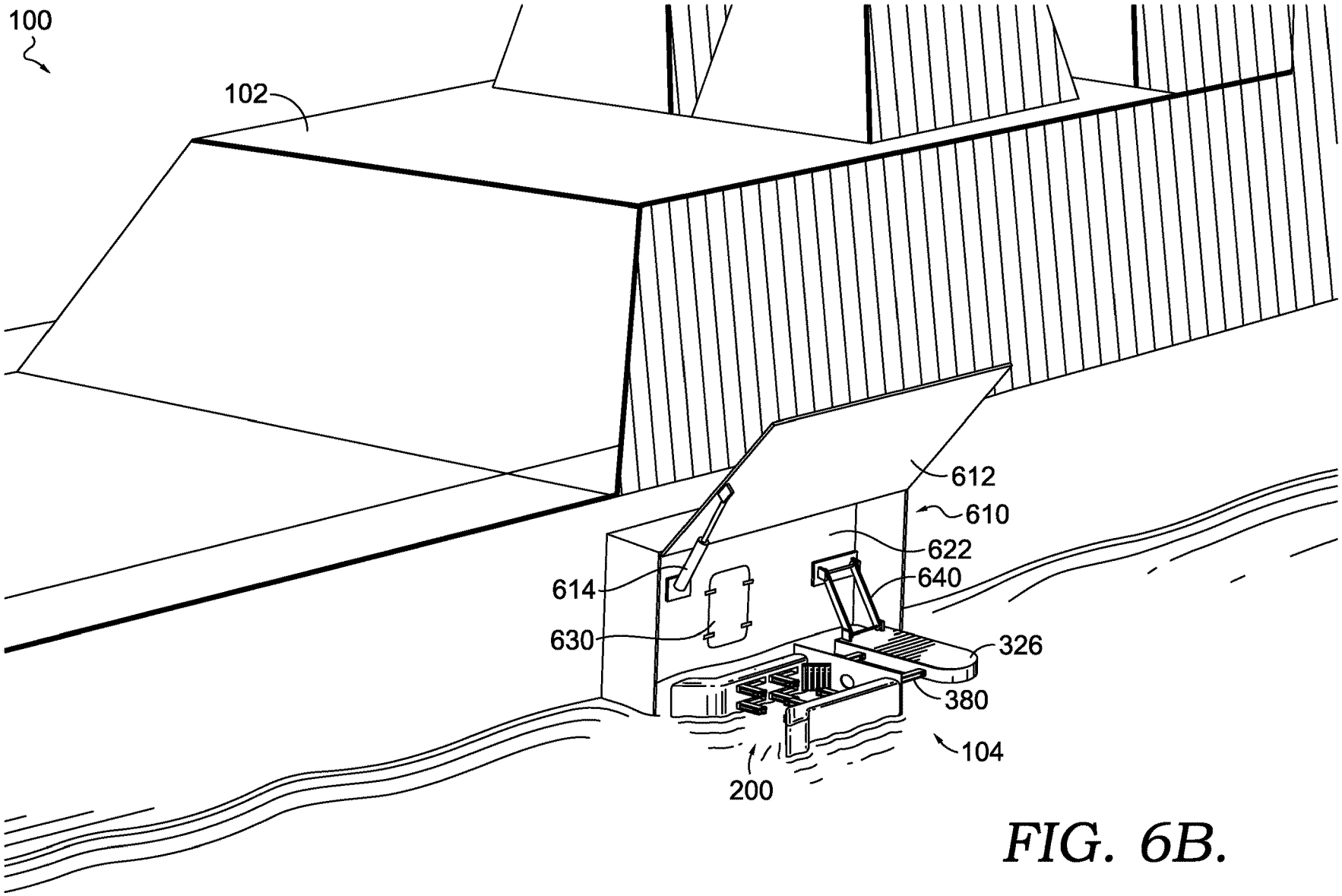

Turning now to FIGS. 6A-8B, various embodiments of the shipborne recovery system 100 of FIG. 1 are illustrated. FIGS. 6A and 6B illustrate embodiments that have the AACS 104 integrated into the side of the host ship 102. Side-integrated embodiments of the shipborne recovery system 100 may comprise a compartment 610 for stowing the AACS 104 when not in use. The compartment 610 may comprise a boom arm 640 that couples the AACS to a compartment bulkhead 620. Though shown connected to the deployment component 326, the boom arm 640 may alternatively or additionally be connected to the cradle 200. The deployment component 326 may be buoyant (e.g., a float, pontoon, barge) or may be an outward-extending arm to which the standoff arms 380 are connected. The compartment bulkhead 620 may comprise an access 630 (e.g., a watertight fitting such as a quick acting water tight door or water tight hatch) that permits the compartment 610 to be accessed from within the host ship 102. The compartment 610 may further comprise a gate 612 operated by actuator 614 that, when operated moves the gate 612 to permit deployment or stowage of the AACS 104 from the compartment 610. As illustrated in FIG. 6A, the compartment 610 may be integrated into the host ship 102 so as not to protrude from the host ship's hull when the AACS 104 is stowed. As illustrated in FIG. 6B, the compartment 610 may be attached onto the hull of the host ship 102 (e.g., if the shipborne recovery system 100 is retrofitted) such that it at least partially protrudes from the hull of the host ship 102.

Figure 7A:
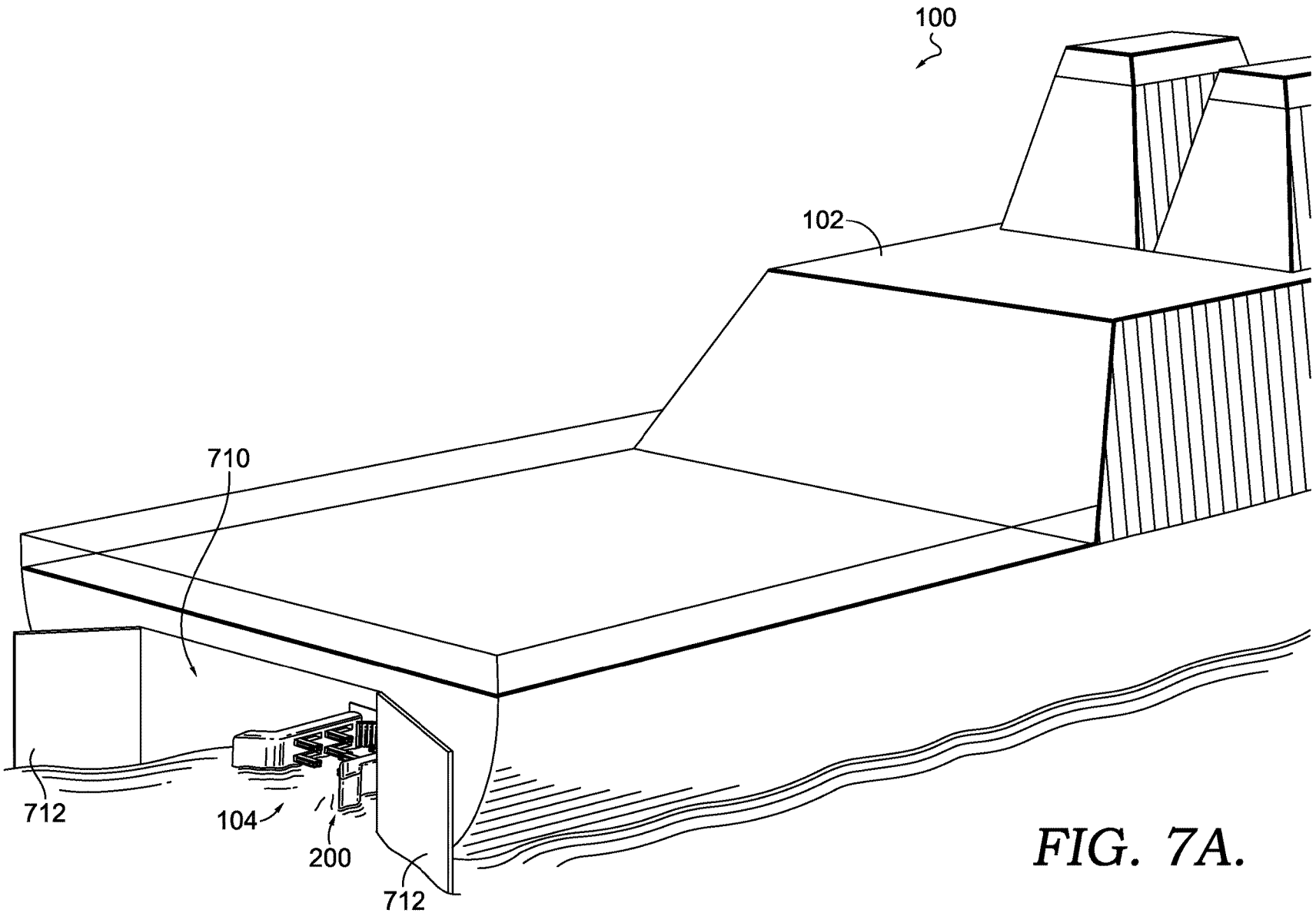
FIGS. 7A-7B illustrate exemplary configurations for integrating an alignment and connection system into the stern of a host ship, implemented in accordance with embodiments of the present invention.
Figure 7B:
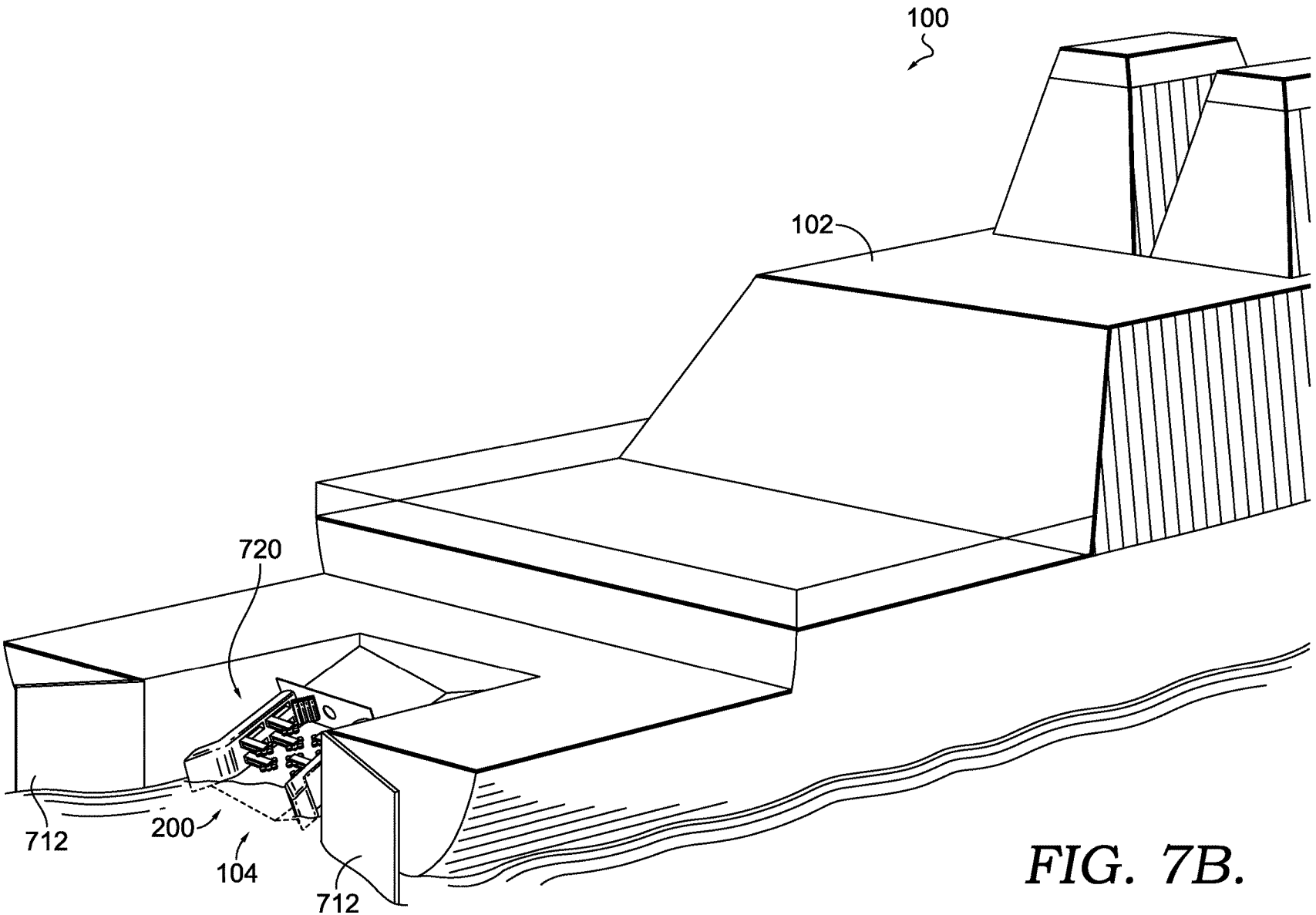

FIGS. 7A-7B illustrate stern recovery embodiments of the shipborne recovery system 100. In a first embodiment, illustrated in FIG. 7A, the shipborne recovery system 100 may be configured with a well deck 710. Any one or more components of the AACS 104, such as the cradle 200 may be tethered or coupled to a desirable fitting within the well deck 710. In another embodiment, illustrated in FIG. 7B, the shipborne recovery system 100 may be configured for a stern ramp 720. Any one or more components of the AACS 104, such as the cradle 200 may be coupled or integrated into the stern ramp 720. In any stern recovery embodiment of the shipborne recovery system 100, one or more stern gates 712 may be operable to protect or prevent water from entering the well deck 710 or stern ramp 720 when the system is not in use.

Figure 8A:
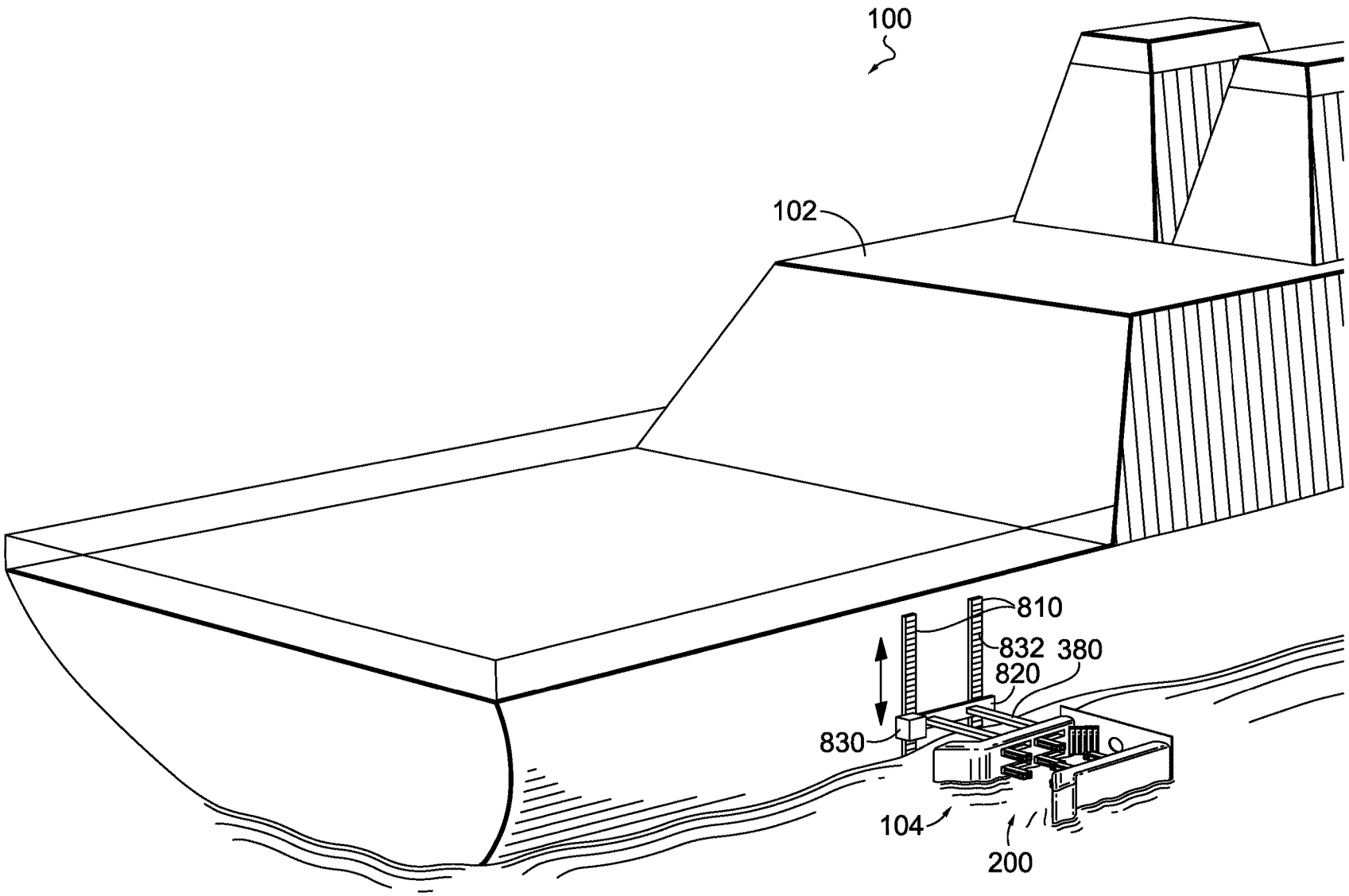
FIGS. 8A-8B illustrate exemplary configurations for launching and recovering an alignment and connection system via an outboard track system, implemented in accordance with embodiments of the present invention.
Figure 8B:
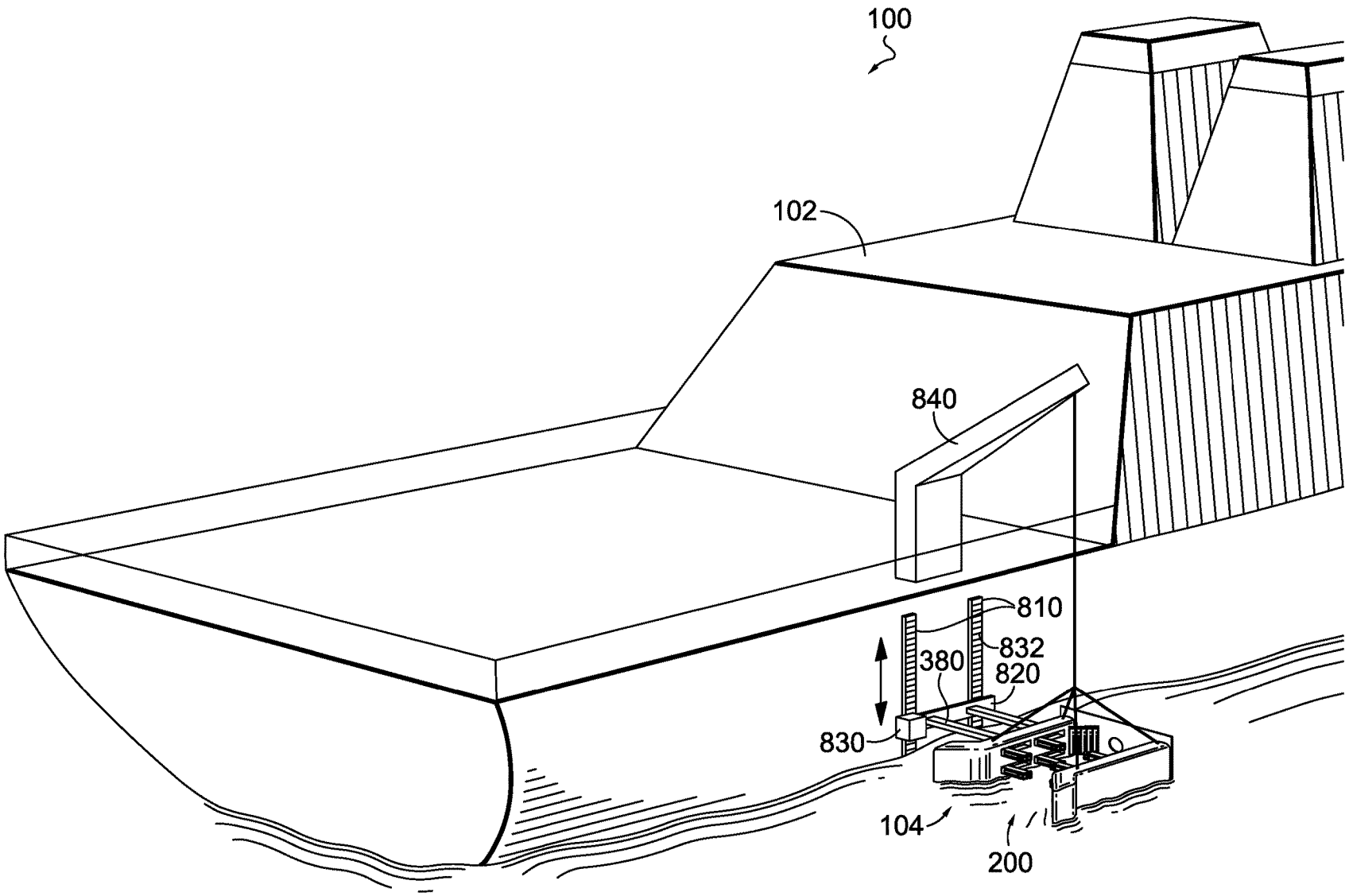

FIGS. 8A-8B illustrated a tracked deployment embodiment of the shipborne recovery system 100. A tracked deployment embodiment may comprise any one or more portions of the AACS 104, such as the cradle 200, one or more tracks 810, and a car 820. The one or more tracks 810, coupled to the hull of the host ship 102 guide the vertical movement of the AACS 104 as it is lowered into the water or hoisted out of the water. In one embodiment, illustrated in FIG. 8A, the car 820 connects the standoff arms 380 to the one or more tracks 810 and a lift component 830 (e.g., a geared motor) interacts with a plurality of rungs 832 in order to ascend or descend the one or more tracks 810. In another embodiment, illustrated in FIG. 8B, the shipborne recovery system 100 may comprise a davit 840 mounted on the host ship 102's deck. The davit 840 may be connected to the AACS 104 at one or more points (e.g., at each quadrant corner of the cradle 200) and operated to raise or lower the AACS 104 out of or into the water.

Many different arrangements of the various components depicted, as well as components not shown, are possible without departing from the spirit and scope of embodiments of the present invention. Embodiments of the present invention have been described with the intent to be illustrative rather than restrictive. Certain features and subcombinations are of utility and may be employed without reference to other features and subcombinations and are contemplated to be within the scope of the claims.

The invention claimed is:

1. A system for capturing and docking a boat, comprising:
- a plurality of cradle arms, each of the plurality of cradle arms coupled to an aft surface of a roll plate and comprising:
  - at least one pocket configured to receive one or more alignment arms; and
  - at least one articulating component configured to extend the one or more alignment arms angularly outward from an inner-facing surface of each cradle arm;
- a plurality of alignment arms, each alignment arm of the plurality of alignment arms coupled to a cradle arm of the plurality of cradle arms at a first end of each alignment arm and comprising at least one roller coupled to a second end of the alignment arm, the second end opposite the first end; and
- an alignment ramp coupled to the roll plate, the alignment ramp extending aft at a downward angle from the roll plate,
- wherein the roll plate comprises a hard capture port, the hard capture port comprising:
  - an aperture centered on the roll plate between each of the plurality of cradle arms; and
  - one or more retention components, the one or more retention components coupled to a forward surface of the roll plate at the aperture.

2. The system of claim 1, further comprising one or more standoff arms, each of the one or more standoff arms coupled to the forward surface of the roll plate via a rotating joint at a first end of each of the one or more standoff arms.

3. The system of claim 2, wherein each of the one or more standoff arms is coupled to a boom arm via a second rotating joint at a second end of each of the one or more standoff arms, the second end opposite the first end.

4. The system of claim 1, wherein the hard capture port further comprises a locking assembly, the locking assembly configured to operably restrict an outward motion, relative to a center line of the aperture, of the one or more retention components.

5. The system of claim 4, wherein the hard capture port is configured to receive and capture a spheroid.

6. The system of claim 1, wherein the alignment ramp comprises a first layer and a second layer, and wherein a first surface of the first layer is coupled to a first surface of the second layer, the first layer having a greater rigidity than the second layer.

7. The system of claim 6, wherein the second layer is resistant to corrosion.

8. The system of claim 7, wherein the alignment ramp comprises a first angular portion and a second angular portion, the first and second angular portion meeting to form a keel.

9. The system of claim 8, wherein each of the first and second angular portions are linear, and wherein the keel is V-shaped.

10. The system of claim 8, wherein each of the first and second angular portions are curved, and wherein the keel is U-shaped.

11. The system of claim 6, wherein the alignment ramp is planar.

12. The system of claim 6, wherein an aft portion of the alignment ramp is inferior to a forward portion of the alignment ramp.

13. The system of claim 1, further comprising a service transfer port configured to receive services from the boat while the boat is coupled to the hard capture port.

14. The system of claim 1, wherein the service transfer port comprises a refueling port configured to facilitate refueling the boat while the boat is coupled to the hard capture port.

15. A system for capturing and docking a boat, comprising:

a plurality of cradle arms, each of the plurality of cradle arms coupled to an aft surface of a roll plate and comprising:

at least one pocket configured to receive one or more alignment arms; and at least one articulating component configured to extend the one or more alignment arms angularly outward from an inner-facing surface of each cradle arm and configured to releasably hold a docked boat in a predetermined position; and a plurality of alignment arms, each alignment arm of the plurality of alignment arms coupled to a cradle arm of the plurality of cradle arms at a first end of each alignment arm and comprising at least one roller coupled to a second end of the alignment arm, the second end opposite the first end; and an alignment ramp coupled to the roll plate, the alignment ramp extending aft at a downward angle from the roll plate.

16. A shipborne recovery system comprising:

an alignment and connection system comprising:

a plurality of cradle arms, each of the plurality of cradle arms coupled to an aft surface of a roll plate; and an alignment ramp coupled to the roll plate, the alignment ramp extending aft at a downward angle from the roll plate, wherein the roll plate comprises a hard capture port, the hard capture port comprising:

an aperture centered on the roll plate between each of the plurality of cradle arms; and one or more retention components, the one or more retention components coupled to a forward surface of the roll plate at the aperture; and a host ship.

17. The shipborne recovery system of claim 16, further comprising a deployment component coupling the alignment and connection system to the host ship.

18. The shipborne recovery system of claim 17, wherein the deployment component comprises a boom arm coupled to a side of the host ship at a first end and the alignment and connection system at a second end.

19. The shipborne recovery system of claim 16, wherein the alignment and connection system is disposed in a stern ramp of the host ship.

20. The shipborne recovery system of claim 16, wherein the alignment and connection system is disposed in a well deck of the host ship.

* * * * *